United States Patent [19]

Houdart

[11] 4,224,584

[45] Sep. 23, 1980

[54] DIRECTIONAL MICROWAVE COUPLER

[75] Inventor: Michel Houdart, Paris, France

[73] Assignee: Thomson-CSF, Paris, France

[21] Appl. No.: 18,893

[22] Filed: Mar. 9, 1979

[30] Foreign Application Priority Data

Mar. 14, 1978 [FR] France ..... 78 07281

[51] Int. Cl.[2] ..... H01P 5/18

[52] U.S. Cl. ..... 333/116; 333/238

[58] Field of Search ..... 333/116, 238, 246

[56] References Cited

U.S. PATENT DOCUMENTS

| | | | |
|---|---|---|---|
| 3,593,208 | 7/1971 | Smith | 333/116 X |
| 3,611,153 | 10/1971 | Wen | 333/116 X |
| 3,769,617 | 10/1973 | West | 333/238 |
| 4,152,680 | 5/1979 | Harrison | 333/246 |

*Primary Examiner*—Paul L. Gensler

*Attorney, Agent, or Firm*—Cushman, Darby & Cushman

[57] ABSTRACT

A directional microwave coupler with, on one face of a substrate of dielectric material, an arrangement of conductive zones and strips forming two coplanar lines. The central conductive strips of the coplanar lines continue into other conductive strips, with a transverse conductive strip forming an electrical connection between the central conductive strips of the coplanar lines and the other conductive strips. The second face of the substrate of dielectric material opposite from the first face is provided with a conductive underlay which is coupled electrically to a central conductive zone common to the coplanar lines. The conductive underlay in conjunction with the other conductive strips forms microstrip lines.

11 Claims, 6 Drawing Figures

DIRECTIONAL MICROWAVE COUPLER

The present invention has as an object a coupled-line directional microwave coupler which can be used in particular in microwave circuits and microcircuits.

Figure 1:
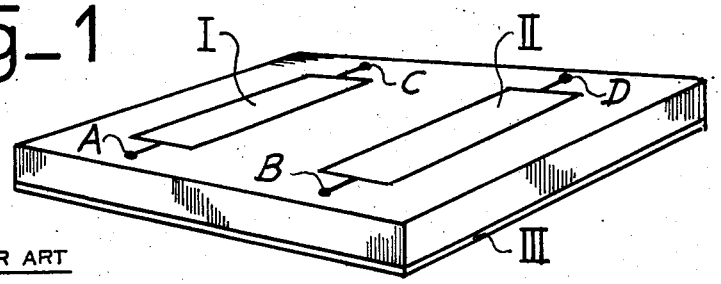

A directional coupler is an octopole circuit having eight terminals or four ports. Directional couplers are generally produced from two microstrip transmission lines which are coupled together on the same substrate of dielectric material, thus forming, as shown in FIG. 1, a system embracing three conductors I, II, III, with one of the conductors acting as a reference potential for the multiconductor system and conductors I and II, which are arranged on one and the same face of the substrate, forming the coupled microstrip lines. FIG. 1 is a schematic view of a coupler of this kind, the ports A, B, C, D being identified as shown in this Figure. Assuming that the propagation of the microwave signals takes place in a homogeneous medium and assuming that the system is symmetrical in respect of the electrical characteristics of the coupled lines (transfer coefficients of zero between ports A, D and between ports B, C and equal transfer coefficients between ports B, D and A, C and equal transfer coefficients between ports B, A and D, C), a so-called directional coupler is obtained which operates in the following way:

With a coupler whose inputs are terminated with impedances equal to the characteristic impedance of the coupler, a generator not represented FIG. 1 and connected to port A for example, which generates an available power Po enables a power $PB=k^2$ Po to be obtained at port B, which is termed the coupled channel, and a power $PC=(1-k^2)$ Po at port C which is termed the direct channel. Port C transmits no power and is completely decoupled, the decoupling being independent of frequency.

The coefficient k is termed the coupling coefficient and is a function of the electrical characteristics of the coupled lines and of the frequency of the signal emitted by the generator. The coupling coefficient k reaches its maximum, as a function of frequency, when the coupling length L of the lines is substantially equal to $\lambda/4$, where $\lambda$ is the wavelength of the signal transmitted by the coupled lines, and the phase shift between the waves emerging from ports B and C is equal to $\pi/2$.

Because of the electrical symmetry of the above coupler, its principle of operation remains the same if the generator is connected to another port, the electrical symmetry usually being achieved by producing a coupler which is mechanically and geometrically symmetrical about a plane of symmetry of the substrate of dielectric material, such as is the case for example with couplers of the kind formed by two parallel coupled microstrip lines.

In cases where the propagation of the signals along the coupled lines takes place in a non-homogeneous medium, the port forming the decoupled channel transmits energy whose level is other than zero and the directivity D of the coupler, which is defined as the ratio of the power transmitted by the decoupled channel ($D=PC/PD$ in the above example), is no longer infinite, the directivity value depending upon the intrinsic characteristics of the lines and the frequency of the transmitted signals.

The transfer coefficients of such a coupler no longer meet the above conditions and the conditions under which the signals are propagated on the coupled lines may result in two distinct modes of propagation existing conjointly on each line, these being a so-called even mode and a so-called odd mode for which the velocities of propagation are different. The directivity D of the coupler is then a function of the frequency of the signals and the velocities of propagation of the odd and even modes. In this case the system of coupled lines must be symmetrical, that is to say the influencing coefficients of, and also the induction coefficients of the lines must be symmetrical since any defect in electrical symmetry results in a change in the performance of the coupler and in particular in its directivity.

Various solutions have been proposed with the aim of improving the performance of directional couplers of this kind. The general principle common to the various solutions is based on the use of directional couplers whose structure is mechanically or geometrically symmetrical about a plane of symmetry of the substrate which is orthogonal to the dielectric carrier for the coupled lines and parallel to the direction of propagation of signals along the said coupled lines, the electrical symmetry of the coupler being derived from this geometrical or mechanical symmetry.

In particular, the coupling of two parallel microstrip lines separated by a coupling gap has been described in an article entitled "Parameters of Microstrip Transmission Lines and of Coupled Pairs of Microstrip Lines" by Thomas G. Bryand and Jerald A. Weiss published in the journal "IEEE Transactions on Microwave Theory and Thechniques" volume MTT 16, No. 12, December 1968, pages 1021 to 1027. However a device of this kind employing such coupling will not allow coupling to be obtained which is equivalent to the transmission along the coupled channel of power attenuated by less than 3 dB, the coupling gap between the lines being of the order of 4 micrometers and being difficult to produce. The use of microstrip lines coupled to interdigital conductors, although it allows the coupling gap to be larger, necessitates not only very close manufacturing tolerances of the order of 1 micrometer, but also the use of a considerable number of interconnections between the various conductive strips. These interconnections can only be made by means of conductive wires which are connected to the strips by thermo-compression and with this technique to exact reproduction of couplers of the kind in question raises many problems.

Other coupler systems have been proposed. In particular, the kind of coupler described in an article by F. C. de Ronde in a report entitled "A new class of microstrip directional couplers" which was published in the journal "IEEE, International Microwave Symposium", May 1970, pages 184 to 186, comprises a system for coupling together a slot line and a microstrip line. Couplers of this kind have the particular disadvantage that they require the two planes of the slot line to be close together and because of this their use is retricted to applications where the coupling coefficients are of the order of 3 dB.

In particular, the directional coupler which forms the subject of the invention enables the abovementioned disadvantages to be overcome by virtue of a suitable arrangement for the conductors forming the coupled lines. With this arrangement it is no longer necessary, if required, to observe the requirement for mechanical or geometrical symmetry in the structure of the coupler but the electrical symmetry of the coupler according to the invention is preserved nevertheless.

Another object of the present invention is a coupler which enables there to be achieved a level of attenuation to the energy transmitted by the coupled channel of less than 2 dB.

The directional microwave coupler according to the invention comprises, on the one hand, on a first face of a substrate of dielectric material, an arrangement of conductive zones and strips respectively forming two coplanar lines having a common central conductive zone, the central conductive strips of the two coplanar lines continuing into further respective conductive strips, a transverse conductive strip forming an electrical connection between the conductive strips into which the central strips of the coplanar lines continue and the central conductive strips of the coplanar lines, and, on the other hand, on a second face of the substrate opposite from the first face, a conductive underlay coupled electrically to the central conductive zone common to the coplanar lines, the conductive underlay forming, in conjunction with the conductive strips into which the central strips of the coplanar lines continue, microstrip lines, the coplanar lines and the microstrip lines formed by the conductive strips into which the central strips of the coplanar lines continue each forming one channel of the coupler.

Such couplers may be used in any microwave circuits.

Figure 2:
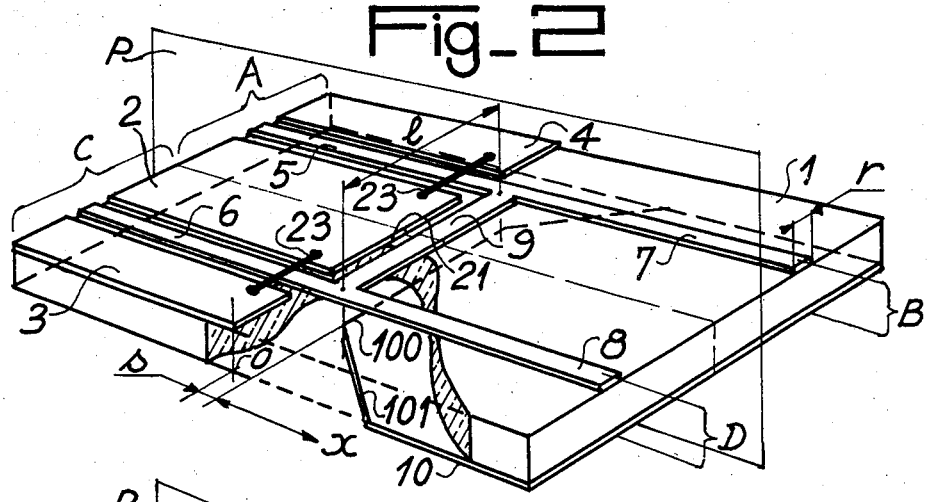
PRIOR ART Fig 2
Figure 3:
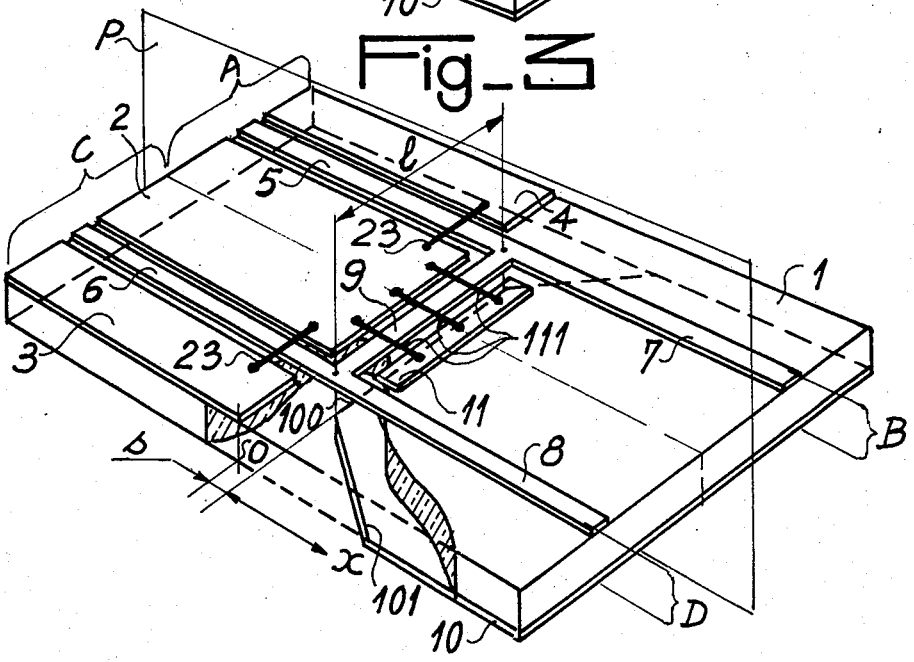
Figure 4:
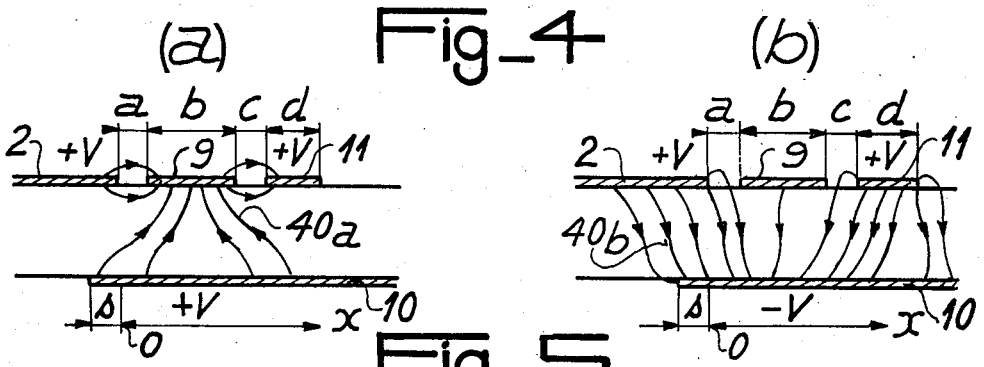
Figure 5:
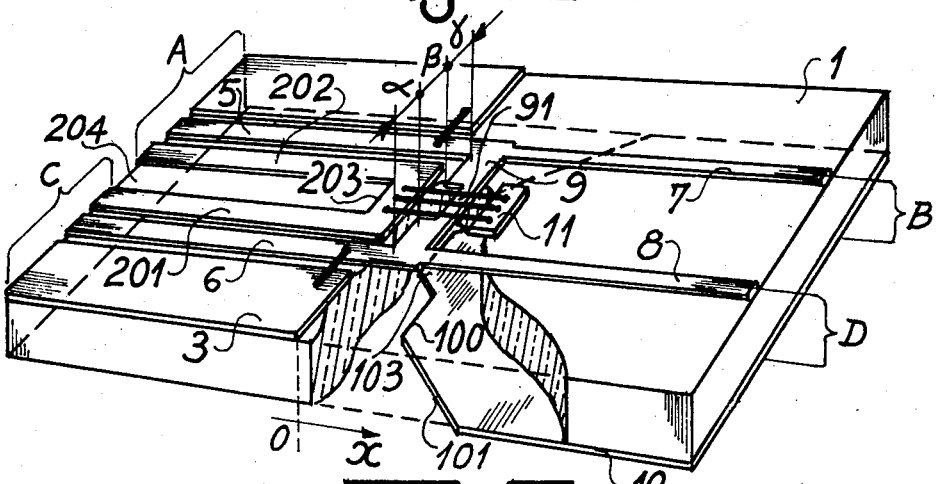

The invention will be better understood from the following description and drawings in which the various elements are not shown in their correct relative proportions and size to ensure better overall comprehension, and in which, apart from FIG. 1 which concerns prior art, FIG. 2 is a partly broken away perspective view of a coupler which forms the subject of the invention, FIG. 3 is a perspective view of a modified embodiment of the coupler according to the invention which is shown in FIG. 2, FIGS. 4*a* and 4*b* are sectional views, in a longituidnal plane of symmetry P of the substrate, showing the distributions of the electrical fields corresponding to the odd and even modes of propagation repsectively, FIG. 5 is a partly broken-away perspective view of another embodiment of the coupler according to the invention.

FIG. 6 is once again a partly broken-away perspective view, of a so-called folded microwave coupler in which the energising channel A and the decoupled channel D are on the same side of the substrate of dielectric material.

As shown in FIG. 2, the directional microwave coupler according to the invention has at least two coupled transmission lines on one and the same substrate 1 of dielectric material. As an example, the dielectric material may be formed by alumina. The substrate of dielectric material is preferably in the form of a wafer having a first plane face and a second plane face parallel to and opposite from the first face. On the first face of the substrate the directional microwave coupler has an arrangement of conductive zones and strips which respectively form two coplanar lines comprising a central conductive zone 2 common to the coplanar lines and conductive zones 3 and 4. A first conductive strip 5 and a second conductive strip 6 form the central conductive strips of respective ones of the coplanar lines. The central conductive strips of the coplanar lines respectively continue into third and fourth conductive strips which are marked 7 and 8 respectively.

The conductive strips 7 and 8 into which the central conductive strips of the coplanar lines continue are, for example, aligned with respective ones of the latter and may be of widths r, or dimensions in a direction perpendicular to the direction of propagation of the signals along the coplanar lines, which are different or the same.

The first face of the substrate of dielectric material also carries a fifth, transverse conductive strip 9 which is, for example, orthogonal to the central conductive strips of the coplanar lines and which forms an electrical connection between on the one hand the two conductive strips 7 and 8 into which the central conductive strips of the coplanar lines continue and on the other hand the central conductive strips of the coplanar lines.

On its second face, the substrate of dielectric material also has a conductive underlay 10 which is coupled electrically to the central conductive zone 2 common to the coplanar lines. The electrical coupling between the conductive zone 2 common to the coplanar lines is defined by the length s for which the conductive underlay 10 is overlapped by the central conductive zone 2 common to the coplanar lines. In the direction in which signals are propagated along the coplanar lines, the length of overlap s is defined from the extremity of the central conductive zone 2 in this direction, which direction is represented by axis ox.

In the non-limiting embodiment shown in FIG. 2, the extremity of the central conductive zone 2 situated near the transverse conductive strip 9 is formed by a straight edge 21 orthogonal to the parallel conductive strips 5 and 6. Allowing for the convention adopted, the length of overlap s may be positive or negative with reference to the origin O, a negative length corresponding to the conductive underlay 10 being in fact overlapped by the central conductive zone 2 and to very close coupling for the coupler, and a positive length corresponding to the conductive underlay 10 not being overlapped by the central conductive zone 2 and to looser coupling. By selecting the value of the parameter s, the length of overlap, it is possible to adjust the coupling selected for the coupler.

At its overlapping end, the conductive underlay 10 is preferably in the form of a straight edge 100 parallel to the straight edge 21 of the central conductive zone 2 common to the coplanar lines. The straight edge 21 of the central conductive zone 2 and the straight edge 100 are of a dimension e which enables the central operating frequency of the coupler to be fixed. The straight edge 100 of the conductive underlay 10 and the size of the conductive underlay 10 in a direction parallel to the straight edge 100 of its overlapping end is defined by two oblique edges 101 which are symmetrical about a longitudinal plane of symmetry P of the dielectric substrate, the conductive underlay 10 thus being of trapezoid shape at the end where it is coupled to the common central conductive zone 2, which enables the maximum impedance to be presented at the input terminals of the coupler in its operating band. In conjunction with the conductive strips 7 and 8 into which the central strips of the coplanar lines continue, the conductive underlay 10 forms microstrip lines, the coupling zone being formed in essence by conductors 9, 2 and 10. The transverse conductive strip 9 is arranged close to edge 21 of the central conductive zone 2 and parallel to the said edge. The coplanar lines and the microstrip lines formed by the metallic strips into which the central strips of the coplanar lines continue each form one channel of the coupler.

The directional microwave coupler which is the subject of the invention and which is shown in FIG. 2 operates as follows:

The coupling zone, which corresponds, in particular, to the area of overlap between the conductive underlay 10 and the central conductive zone 2, is formed by the central conductive zone 2, the conductive underlay 10 and the transverse conductive strip 9. The energisation zones form the inputs to the coupler. Port A is formed by conductors 2, 4, 5 and conductors 2 and 4 are raised to the same potential via a conductor 23. Port A is subject to energisation of the coplanar line kind with conductive zones 2 and 4 forming the ground planes of the coplanar line. Port B is formed by conductors 7 and 10, the propagation of signals taking place along the microstrip line formed by the conductive strip 7 and the conductive underlay 10, with the conductive underlay 10 acting as the conductor at the reference potential for the microstrip line.

Port C is formed by conductors 2, 3, 6 and is subject to energisation of the coplanar line kind in a similar way to port A, conductors 2 and 3 being raised to the same potential via a conductor 23. The conductors 23 are for example gold wires connected by thermocompression, and the conductive zones 2, 3 and 4 act as the conductors at the reference potential for the coplanar lines.

Port D is formed by the conductive underlay 10 and the conductive strip 8, the propagation of signals taking place along the microstrip line formed by the conductive strip 8 and the conductive underlay 10. The conductive underlay 10 once again acts as the conductor at the reference potential for the microwave strip.

In contrast to conventional systems, the coupling takes place by way of the coupling between the conductive planes at the reference potential belonging to the various ports. Thus, from the point of view of coupling, the central conductive zone 2 and the conductive underlay 10 act as the conductors I and II respectively of a conventional coupler as shown in FIG. 1 but since these conductors are not situated in the same plane, the coupling is closer the larger the absolute value of the length of overlap s, which, with the convention adopted, is negative. From the point of view of coupling, the transverse conductive strip 9 acts as the conductor III of the conventional coupler shown in FIG. 1, the transverse conductive strip 9 thus acting as a reference potential for the system of coupled conductors i.e. the central conductive zone 2 and the conductive underlay 10.

The performance of the coupler according to the invention can be determined by analysing the coupling parameters of the system of conductors, 10, 2, 9 and, with a value $\epsilon r$ for the relative permittivity of the dielectric material, it sets the values of the length of overlap s and the dimensions in direction ox of the gap a between the edge 21 of the central conductive zone 2 and the transverse conductive strip 9 situated near the said central conductive zone 2, and the width b of the transverse conductive strip 9. The coupling length l defined above is dictated by the operating frequency of the coupler. References a and b are shown in FIGS. 4*a* and 4*b* only in order to keep FIG. 2 clear.

In a particular embodiment of the invention, which is shown in FIG. 3, the microwave coupler also has, on the first face of the substrate of dielectric material, an additional conductive zone 11 situated close to the transverse conductive strip 9 and between the conductive strips 7 and 8 into which the central conductive strips of the coplanar lines continue. This additional conductive zone 11 is connected electrically to the central conductive zone 2 common to the two coplanar lines, by means of conductors 111 which are connected by thermocompression for example. From the electrical point of view, because of the presence of the conductors 111, the conductive zones 2 and 11 are at equal potentials and the additional conductive zone 11 thus enables to increase the equivalent length to which the conductive underlay 10 is overlapped by the equipotential conductive zones 2 and 11. The additional conductive zone is preferably formed, in the vicinity of the transverse conductive strip 9, by a rectangular conductive strip arranged parallel to the transverse conductive strip 9 and to the straight edge 21 of the central conductive zone common to the coplanar lines. In this case, deciding the performance of the coupler shown in FIG. 3 is also a question of defining, in direction ox, the gap c between the transverse conductive strip 9 and the additional metallic strip 11, and the width d of the conductive zone 11. References c and d are shown in FIGS. 4*a* and 4*b* only in order to keep FIG. 3 clear.

FIGS. 4*a* and 4*b* are views in section, on the longitudinal plane of symmetry P of the dielectric substrate, of the configurations of the electrical fields, in the mode of propagation termed the even mode and in the mode of propagation termed the odd mode respectively. Because the coupler is electrically symmetrical, the even mode is characterised by the conductive underlay 10, the central conductive zone 2 and the additional conductive zone 11 being at equal potentials, with the transverse conductive strip 9 acting as a potential reference for the system of coupled conductors. The distribution of the electrical field lines 40*a* in the even mode is shown in FIG. 4*a*.

Similarly, because the coupler is electrically symmetrical, the odd mode is characterised by the conductive underlay 10 being at the opposite potential from the central conductive zone 2 and the additional conductive zone 11. In the case of the odd mode the transverse conductive strip 9 once again acts as a potential reference for the system of coupled conductors. Ths distribution of the electrical field lines 40*b* in the odd mode is shown in FIG. 4*b*.

The coupler derives its electrical symmetry from the following approximated relationship:

$$\frac{CII_o - C22_o}{CII_\epsilon - C22_\epsilon} = \sqrt{\frac{C_o^2 - C12_o^2}{C_\epsilon^2 - C12_\epsilon^2}}$$

in which: $CII_o$ and $CII_\epsilon$ represent, respectively for a value $\epsilon r = 1$ and a value of $\epsilon r$ appropriate to the dielectric material concerned, the coefficients of influence of the central conductive zone 2 as given by the matrix of coefficients of influence of the multiconductor system formed by the central conductive zone 2, the transverse conductive strip 9 and the conductive underlay 10, in which the central conductive strip 9 is assumed to be at the reference potential, $C22_o$ and $C>_\epsilon$ represent, respectively for a value $\epsilon r = 1$ and for the value of $\epsilon r$ appropriate to the dielectric material concerned, the coefficients of influence of the conductive underlay 10 as defined by the matrix of coefficients of influence of the multiconductor system formed by the central conductive zone 2, the transverse conductive strip 9 and the conductive underlay 10, in which the central conductive strip 9 is assumed to be at the reference potential, $C_o$ is the arithmetic mean of the coefficients $CII_o$ and $C22_o$, $C_\epsilon$ is the arithmetic mean of the coefficients $CII_\epsilon$ and $C22_\epsilon$, $C12_o$ and $C12_\epsilon$ represent, for a value $\epsilon r = 1$ and for the value of $\epsilon r$ appropriate to the dielectric material concerned; the mutual coefficients of influence of the central conductive zone 2 and the conductive underlay 10 as given by the matrix of coefficients of influence of the multiconductor system formed by the conductors 2, 9 and 10, in which the central conductor strip 9 is assumed to be at the reference potential.

The coupling coefficient k in decibels, expressed as a function of the above parameters is given by the equation:

$$k_{dB} = 20 \log \frac{\sqrt{(C_o - C12_o)\ (C - C12) - (C_o + C12_o)\ (C + C12)}}{\sqrt{(C_o - C12_o)\ (C - C12) + (C_o + C12_o)\ (C + C12)}}$$

In another embodiment of the invention which is shown in FIG. 5, the directional microwave coupler is a multi-segment coupler. By associating a plurality of coupling segments in series it is possible, in particular, to increase the operating band of the coupling device. With this in view, the transverse conductive strip 9 is formed from a plurality of sections which constitute the various segments of the coupling device. In direction ox, the dimensions of the sections are different, which enables a coupling coefficient k to be defined for each segment which is peculiar to that segment. By way of non-limiting example and as shown in FIG. 5, the directional microwave coupler according to the invention may be a three-segment coupler. To this end, the transverse conductive strip 9 has a constricted portion 91 which defines the three segments $\alpha$, $\beta$, $\gamma$. In a direction perpendicular to ox, the size of the constricted portion 91 which defines the central segment $\beta$ and the adjacent segments $\alpha$ and $\gamma$ is substantially equal to $\lambda/4$, where $\lambda$ is the wavelength of the signal transmitted by the lines. Similarly, the edge 100 of the conductive underlay 10 has, opposite the constricted portion 91, a jutting-out portion 103 whose size in a direction perpendicular to ox is equal to $\lambda/4$. This jutting-out portion 103 of the conductive underlay enables the coupling for the central segment $\beta$ to be increased by altering the length of overlaps s at the point where segment $\beta$ is situated. To give an example, by forming a coupler having three segments with respective coupling coefficients of $$k(\alpha) = 13 \text{ db},\ k(\beta) = 1.4 \text{ db and } k(\gamma) = 13 \text{ db},$$

it was possible to produce a 3 db coupler operating in a frequency band between 2 GHz and 9.7 GHz.

As is also shown by way of non-limiting example in FIG. 5, the central conductive zone 2 common to the coplanar lines is divided into two detached central conductive zones 201 and 202 separated by a non-conductive gap 204. The size of the gap 204 in a direction perpendicular to ox is preferably equal to the size in the same direction of the constricted portion 91 of the transverse conductive strip 9 and the gap is preferably situated in line with the latter. The ends of the two central conductive zones 201 and 202 situated in the vicinity of the transverse conductive strip 9 are connected by a conductive strip 203. For the central segment $\beta$ the conductive strip 203 forms a conductive coupling zone of finite dimensions which enables the coupling of the central segment $\beta$ to be adjusted.

Figure 6:
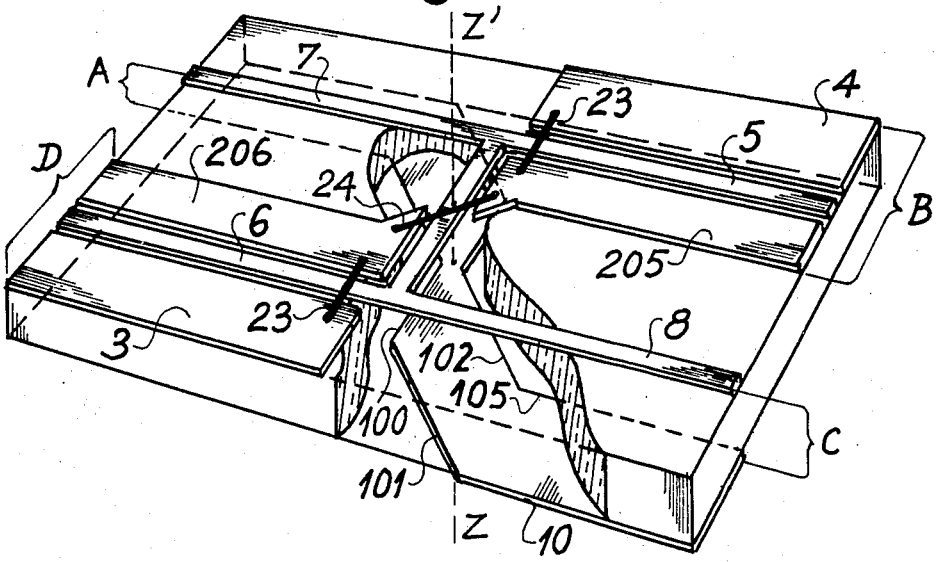

The embodiment of the coupler according to the invention shown in FIG. 6 is a folded coupler. This embodiment is suitable for applications where it is helpful to bring together the energisation channel formed by port A and the decoupled channel formed by port D on the same side of the dielectric substrate. In comparison with the microwave coupler according to the invention which is shown in FIG. 2, the non-limiting embodiment of folded coupler in FIG. 6 is, symmetrical about an axis ZZ' orthogonal to the axis of symmetry of the substrate. The coplanar lines and the microstrip lines are for example arranged symmetrically about axis ZZ', the common central conductive zone being divided in two conductive zones 205, 206 which are symmetrical about axis ZZ' and which are connected by a conductor 24. The microwave lines are arranged substantially in respective ones of two quadrants of the surface of the substrate which are symmetrical about axis ZZ'. In this way, the port A formed by the microstrip line is represented by the conductive strip 7 and the conductive underlay 10 which latter, on the second face of the substrate od dielectric material, at most covers two first quadrants defined by the orthogonal planes of symmetry of the substrate which intersect at axis ZZ', the first two quadrants being symmetrical about axis ZZ'. In the non-limiting embodiment shown in FIG. 6, the conductive underlay 10 comprises two parts which are symmetrical about axis ZZ' and which are defined by edges 100, 101, 102 and 105. Similarly port C, which is arranged symmetrically with port A about axis ZZ', is formed by the microwave line represented by the conductive underlay 10. Similarly the ports B and D formed by the coplanar lines are represented by the conductive strips 5 and 6 respectively and the conductive zones 4, 205 and 3, 206 respectively, which are for example symmetrically arranged about axis ZZ'. The conductive zones 4, 3 and 205, 206 forming the coplanar lines cover, on the first face of the dielectric material, at most the two quadrants adjacent the first two quadrants. The conductive zones 4, 3 and 205, 206 are electrically connected by conductors 23, 24 which are formed for example by gold wires connected to the conductive zones by thermocompression.

There has thus been described a directional microwave coupler which can be used in microwave integrated microcircuits and which enables directional couplers having a good coupling coefficient characteristic to be produced, although the couplers according to the invention are particularly suited to and are of maximum effectiveness with very close coupling.

The couplers according to the invention also make it possible to simplify the techniques used for producing directional couplers. In effect, with the proposed configurations for embodiments of the couplers according to the invention, the dimensions required for the production of a 3 dB coupler are of the order of a few tenths of a millimeter. Because of this, the effect of the thickness of the conductive strips and zones is also reduced, the consequence of which is that the accuracy to which the conductive zones are formed is of very minor importance given the capabilities of conventional screen printing or ion etching processes, thus resulting, finally, in an increase in the reproducibility of coupler performance.

The directional microwave couplers according to the invention also make it easier to incorporate load resistance in the decoupled channel of the coupler by virtue of the proximity of the ground planes and they also allow two propagation techniques using coplanar lines and microwave lines to be combined on a single substrate of dielectric material.

The invention is not restricted to the embodiments described and the making of local modifications to the coupled structure, in particular at the ends of the coupled lines in order to make local changes to the capacitive or inductive coupling between the lines with the object of compensating for the difference between the velocities of propagation of the odd and even modes, does not fall outside the scope of the present invention.

What is claimed is:

1. A directional microwave coupler comprising at least two coupled transmission lines on one and the same substrate of dielectric material, comprising on the one hand, on a first face of the substrate of dielectric material:

an arrangement of conductive zones and strips respectively forming two coplanar lines having a common central conductive zone, the central conductive strips of each of the coplanar lines respectively continuing into other conductive strips and a transverse conductive strip forming an electrical connection between the central conductive strips of the coplanar lines and the conductive strips into which the central conductive strips of the coplanar lines continue, and on the other hand, on a second face of the substrate of dielectric material opposite from the first face, a conductive underlay which is coupled electrically to the central conductive zone common to the coplanar lines, the conductive underlay forming microstrip lines in conjunction with the conductive strips into which the central conductors of the coplanar lines continue, the coplanar lines and the microwave strips formed by the conductive strips into which the central conductive strips of the coplanar lines continue each forming one channel of the coupler.

2. A directional microwave coupler according to claim 1, wherein the arrangement of conductive zones and strips on the first face of the substrate forms a system of two parallel coplanar lines having a common central conductive zone, each of the coplanar lines forming one channel of the coupler, the central conductive strips of the coplanar lines continuing into third and fourth conductive strips which are aligned with respective ones of the central conductive strips of the coplanar lines, the transverse conductive strip which connects the central conductive strips of the coplanar lines being arranged orthogonally to the said lines, the electrical coupling between the conductive underlay and the central conductive zone common to the coplanar lines being decided by the length s to which the conductive underlay is overlapped by the central conductive zone common to the coplanar lines.

3. A direction microwave coupler according to claim 2, wherein the end of the central conductive zone common to the coplanar lines which is situated in the vicinity of the transverse conductive strip is formed by a straight edge orthogonal to the central conductive strips of the coplanar lines, the conductive underlay having, at the point where its overlapping end is situated, a straight edge parallel to the straight edge of the central conductive zone common to the coplanar lines.

4. A directional microwave coupler according to claim 3, wherein the size of the conductive underlay in a direction parallel to the straight edge of its overlapping end is defined by two oblique edges which are symmetrical about a longitudinal plane of symmetry P of the dielectric substrate, the conductive underlay being of trapezoid shape at the end where it is coupled to the central conductive zone common to the coplanar lines, thus allowing maximum impedance to be presented at the input terminals of the coupler.

5. A directional microwave coupler according to claim 1 wherein the first face of the substrate of dielectric material also carries an additional conductive zone which is situated in the vicinity of the transverse conductive strip and between the conductive strips into which the central conductive strips of the coplanar lines continue, the additional conductive zone being connected electrically to the central conductive zone common to the coplanar lines.

6. A directional microwave coupler according to claim 5, wherein the additional conductive zone is formed by a rectangular conductive strip arranged parallel to the transverse conductive strip and parallel to a straight edge of the central conductive zone common to the coplanar lines.

7. A directional microwave coupler according to claim 5, wherein the coupler being a multisegment coupler, the transverse conductive strip is formed in a plurality of sections defining the various segments.

8. A directional microwave coupler according to claim 7, wherein the transverse conductive strip has a constricted portion defining a central segment and two adjacent segments, the dimensions of the central segment and the adjacents in a direction perpendicular to the direction ox in which signals are propagated along the coplanar lines being substantially equal to $\lambda/4$, where $\lambda$ is the wavelength of the signal transmitted by the lines, a straight edge of the overlapping end of the conductive underlay being of increased size opposite the constricted portion in a direction perpendicular to ox, the increase in size being equal to the dimension of the constricted portion in this same direction.

9. A microwave coupler according to claim 5, wherein the central conductive zone common to the coplanar lines is divided into two detached central conductive zones separated by a non-conductive gap, the two central conductive zones having their ends situated near the transverse conductive strip connected by a conductive strip.

10. A directional microwave coupler according to claim 1, wherein the coplanar lines and the microstrip lines are situated substantially in respective ones of two quadrants which are symmetrical about an axis of symmetry ZZ' orthogonal to the substrate, the conductive underlay comprising two parts which, on the second face of the substrate, at most cover two first quadrants defined by orthogonal planes of symmetry of the substrate which intersect on axis ZZ', the conductive zone forming the coplanar lines covering, on the first face of the substrate of dielectric material, at most to two quadrants adjacent the two first quadrants.

11. A directional microwave coupler according to claim 1, wherein the coplanar lines and the microstrip lines are symmetrically arranged about an axis of symmetry ZZ' orthogonal to the substrate of dielectric material substantially in two quadrants of the surface of the substrate which are symmetrical about the axis ZZ', the conductive underlay comprising two parts which are symmetrical about axis ZZ' and which, on the second face of the substrate, at most cover the two first quadrants defined by orthogonal planes of symmetry of the substrate which intersect on axis ZZ', the conductive zones forming the coplanar lines covering, on the first face of the substrate of the dielectric material, at most the two quadrants which are adjacent the first two quadrants symmetrically about axis ZZ'.

* * * * *